US005925938A

United States Patent [19]

Tamor

[11] Patent Number: 5,925,938

[45] Date of Patent: Jul. 20, 1999

[54] ELECTRICAL SYSTEM FOR A MOTOR VEHICLE

[75] Inventor: Michael Alan Tamor, Toledo, Ohio

[73] Assignee: Ford Global Technologies, Inc., Dearborn, Mich.

[21] Appl. No.: 08/811,626

[22] Filed: Mar. 5, 1997

[51] Int. Cl.[6] ..... F02N 11/00

[52] U.S. Cl. ..... 290/31; 318/139; 320/166

[58] Field of Search ..... 322/16, 60; 290/1 R, 290/27, 31, 38 R; 318/139; 320/166

[56] References Cited

U.S. PATENT DOCUMENTS

| | | | |
|---|---|---|---|
| 4,187,436 | 2/1980 | Etienne | 290/27 |
| 5,146,095 | 9/1992 | Tsuchiya et al. | 290/38 R |
| 5,155,373 | 10/1992 | Tsuchiya et al. | 290/38 R |
| 5,155,374 | 10/1992 | Shirata et al. | 290/38 R |
| 5,157,267 | 10/1992 | Shirata et al. | 290/38 R |
| 5,285,862 | 2/1994 | Furutani et al. | 180/65.4 |
| 5,552,681 | 9/1996 | Suzuki et al. | 318/139 |

*Primary Examiner*—Nestor Ramirez
*Assistant Examiner*—Nicholas Ponomarenko
*Attorney, Agent, or Firm*—Mark S. Sparschu

[57] ABSTRACT

In one embodiment of the present invention, an electrical system for a motor vehicle comprises a capacitor, an engine cranking motor coupled to receive motive power from the capacitor, a storage battery and an electrical generator having an electrical power output, the output coupled to provide electrical energy to the capacitor and to the storage battery. The electrical system also includes a resistor which limits current flow from the battery to the engine cranking motor. The electrical system further includes a diode which allows current flow through the diode from the generator to the battery but which blocks current flow through the diode from the battery to the cranking motor.

20 Claims, 1 Drawing Sheet

ELECTRICAL SYSTEM FOR A MOTOR VEHICLE

This invention was made with Government support under Prime Contract No. DE-AC36-83CH10093, Subcontract No. ZCB-4-13032-02, awarded by the Department of Energy. The Government has certain rights in this invention.

BACKGROUND OF THE INVENTION

1. Field of the Invention

The present invention relates to electrical systems for motor vehicles.

2. Description of the Related Art

In city driving, a substantial amount of the fuel consumed by a motor vehicle is consumed when the vehicle is at rest or decelerating. In fact, some studies indicate that fuel economy on the "Federal Urban Drive Schedule" can be increased by up to 20% by turning off the vehicle's engine while the vehicle is stopped or decelerating. When the engine is off, vehicle electrical loads would be supplied from the vehicle's storage battery.

In a vehicle whose engine is turned off during such fuel-saving opportunities, the engine will be cranked more frequently than in other vehicles. Providing the very high-power (though relatively low-energy) electrical pulse to crank and start the engine is, however, very stressful on storage batteries. In fact, the ability of a storage battery to provide the high-power pulse begins to degrade after only a relatively few repetitions, although the overall energy capacity of the battery is not degraded. Thus, a system which would reduce the exposure of the vehicle's storage battery to such high-power engine cranking pulses will prove advantageous.

The addition of a capacitor to the vehicle's electrical system to provide the high-power engine cranking pulse has been proposed, for example, in U.S. Pat. No. 5,146,095, issued to Tsuchiya et al. This system, however, relies on relays to manage the charging and discharging of the capacitor. Other designs may be more cost-efficient and reliable.

In vehicles whose engine stops and starts frequently, for example to take advantages of fuel savings which can be realized, quick vehicle restarts are preferable to minimize annoyance to the driver of the vehicle. Such quick vehicle restarts can be facilitated by providing a particularly large amount of power to the engine cranking motor. A cranking motor operating at a higher voltage than the conventional 12 volts of a motor vehicle electrical system can provide higher power without correspondingly higher electrical currents, an advantageous situation. But, if a cranking motor operating at a higher voltage is used in a system which otherwise uses 12-volt electrical loads, a decision must be made as to the voltage at which electrical energy will be generated and stored in the system. Generating and storing energy at 12 volts will require a voltage up-converter to provide the higher voltage for the engine cranking motor. Using an up-converter to convert a relatively lower voltage to a relatively higher voltage for supply to a higher-voltage motor is known; however, high-power up-converters are very expensive.

Thus, a system which facilitates the use of a higher voltage for vehicle cranking, if desired, while not requiring a voltage up-converter will prove cost-advantageous.

SUMMARY OF THE INVENTION

The present invention provides an electrical system for a motor vehicle. The system comprises a capacitor and an engine cranking motor coupled to receive motive power from the capacitor. The system further comprises a storage battery and an electrical generator having an electrical power output, the output coupled to provide electrical energy to the capacitor and to the storage battery. Also, the system includes current-limiting limiting means for limiting current flow from the battery to the engine cranking motor.

The present invention also provides a second electrical system for a motor vehicle. The system comprises a capacitor and an engine cranking motor coupled to receive motive power from the capacitor. The system additionally comprises a storage battery and an electrical generator having an electrical power output, the output coupled to provide electrical energy to the capacitor and to the storage battery. Further, the system includes blocking means for allowing current flow through the blocking means from the output of the electrical generator to the storage battery and for preventing current flow through the blocking means from the storage battery to the engine cranking motor.

The present invention provides an advantage over the prior art by using a capacitor for engine cranking without requiring relay control of the charging and discharging of the capacitor. A high-reliability and highly cost-effective system can result. Further, the present invention facilitates systems which employ higher-voltage cranking of the vehicle, if desired, without requiring an expensive high-power voltage up-converter to provide that higher voltage.

DETAILED DESCRIPTION OF THE PREFERRED EMBODIMENT

Figure 1:
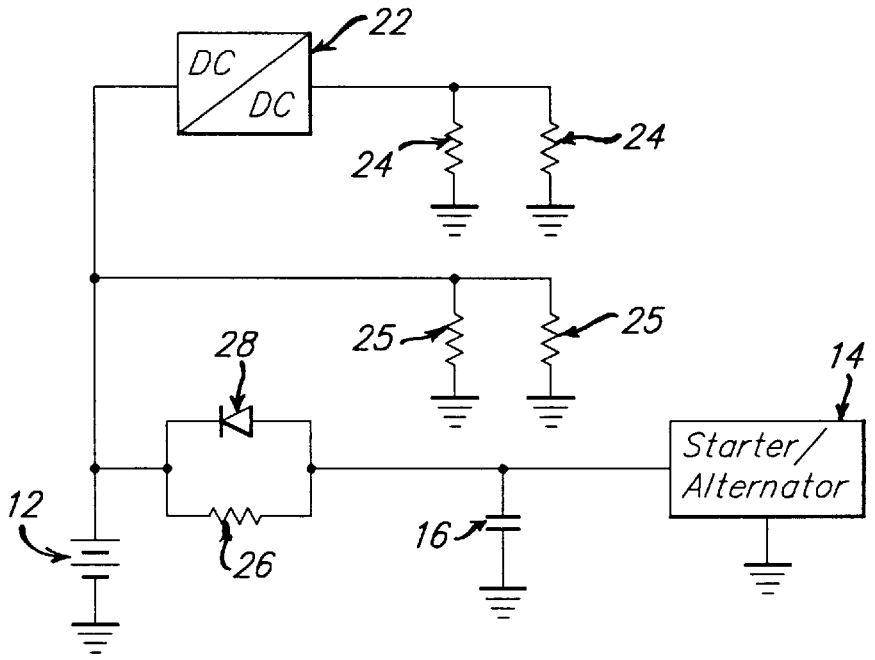
FIG. 1 is an electrical schematic diagram of an electrical system according to one embodiment of the present invention.

Referring first to FIG. 1, an electrical system for a motor vehicle is illustrated. The system includes a storage battery 12. The system further includes a starter/alternator 14. Although starter/alternator 14 is preferably a single component, a separate starter motor and alternator can be provided. Some examples of combined starter/alternators known in the art are disclosed in U.S. Pat. Nos. 4,720,638, 4,916,345, 5,001,412, 5,097,140 and 5,469,820. The disclosures of those patents are hereby incorporated by reference.

The system of FIG. 1 further includes a capacitor 16. Capacitor 16 is of sufficient energy storage capacity to provide engine cranking power to motor/alternator 14 to quickly crank an internal combustion engine (not shown) to which starter/alternator 14 is coupled. Further, to minimize the cranking time required to start the engine, starter/alternator 14 is preferably designed to operate at higher than the 12 volts which is typical in a motor vehicle. Higher power can be delivered for cranking the internal combustion engine without requiring correspondingly higher currents.

Also provided in the electrical system is a DC-to-DC converter 22. DC-to-DC converter 22 converts the relatively higher voltage stored by storage battery 12 into a relatively lower voltage (such as, for example, 12 volts) to power other electrical loads 24 on the vehicle.

The electrical system also may include further relatively-higher voltage loads 25, should the electrical system designer decide to replace some of the vehicle's electrical loads with higher voltage loads. Some of the vehicle's motors, for example, might be run more efficiently and made smaller in size if designed to operate at higher than conventional 12-volt vehicle system voltage. Higher-voltage electrical loads 25 can also include one or more electric "traction" motors adapted to help propel a "hybrid" electric vehicle. In such a case, an inverter might be provided to convert the DC energy from storage battery 12 to AC for the motors.

Further included in the electrical system are a resistor 26 and a diode 28. Resistor 26 functions to limit current which can flow from storage battery 12 to starter/alternator 14. Thus, when the internal combustion engine is to be cranked, capacitor 16 will provide essentially all of the cranking energy and will therefore bear the high-power pulse provided for cranking the internal combustion engine. Storage battery 12 is therefore spared the requirement of providing the high-power cranking pulse.

When starter/alternator 14 instead operates as an alternator to generate electrical energy when the internal combustion engine is running, diode 28 allows starter/alternator 14 to charge storage battery 12 with reasonably high efficiency. That is, losses which would occur if the charging current were to pass through resistor 26 are substantially avoided.

After providing energy for cranking the internal combustion engine, capacitor 16 is recharged by either starter/alternator 14, or if such recharging is not complete when the internal combustion engine 10 is next turned off, by storage battery 12. Electrical losses incurred by recharging capacitor 16 through resistor 26 are insignificant because capacitor 16 stores relatively little energy and because the capacitor-recharging event occurs relatively infrequently.

Thus, the electrical system of FIG. 1 advantageously allows the use of a starter/alternator 14 optimized to perform both the cranking and electrical generating functions at high voltage. Equivalently, the system allows the use of a separate starter and alternator in place of starter/alternator 14 and each designed to take advantage of operating at high voltage.

Figure 2:
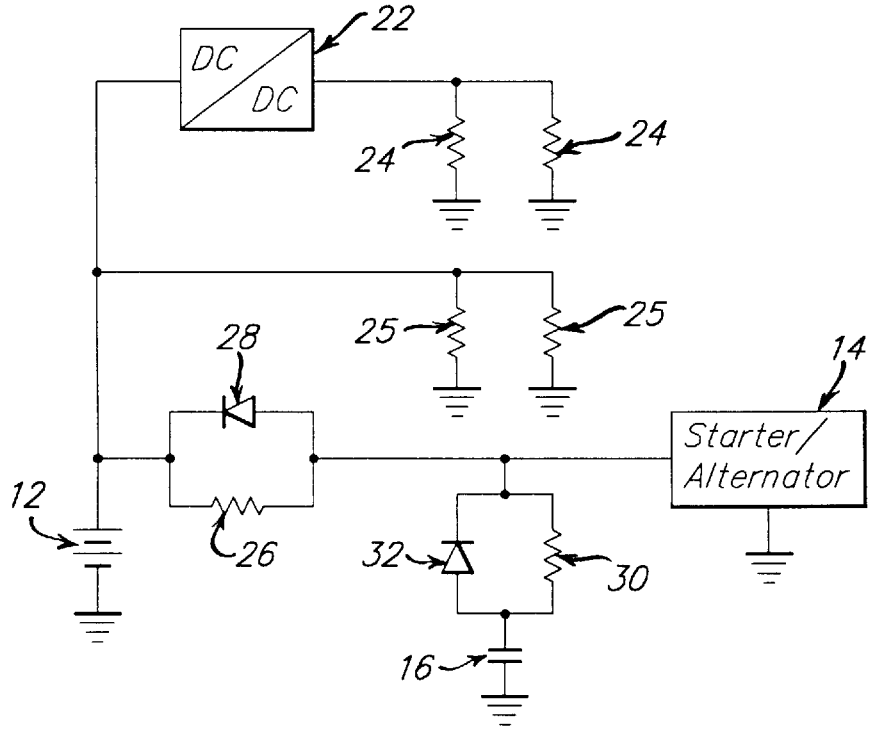
FIG. 2 is an electrical schematic diagram of an electrical system according to a second embodiment of the present invention.

In a variation of the system of FIG. 1, FIG. 2 shows the addition of a second current-limiting resistor 30 and a second diode 32. Current-limiting resistor 30 limits, if desired, the recharging current provided from starter/alternator 14 to capacitor 16. Diode 32 allows the engine cranking energy provided by capacitor 16 to starter/alternator 14 without current limitation by current-limiting resistor 30.

It should be noted that current-limiting resistor 26, diode 28, current-limiting resistor 30 and diode 32 are all passive devices. Thus, the systems according to the embodiments of FIGS. 1 and 2 can be very cost-effective. Alternatively, the functions of some or all of those components can be performed by "active" components, such as transistors, to better optimize performance of the various functions.

Various other modifications and variations will no doubt occur to those skilled in the arts to which this invention pertains. Such variations which generally rely on the teachings through which this disclosure has advanced the art are properly considered within the scope of this invention. This disclosure should thus be considered illustrative, not limiting; the scope of the invention is instead defined by the following claims.

What is claimed is:

1. An electrical system for a motor vehicle, said system comprising:

a capacitor;

an engine cranking motor coupled to receive motive power from said capacitor;

a storage battery;

an electrical generator having an electrical power output, said output coupled to provide electrical energy to said capacitor and to said storage battery;

current-limiting means for limiting current flow from said battery to said engine cranking motor.

2. An electrical system as recited in claim 1, further comprising blocking means for allowing current flow through said blocking means from said output of said electrical generator to said storage battery and for preventing current flow through said blocking means from said storage battery to said engine cranking motor.

3. An electrical system as recited in claim 1, wherein:

said electrical system includes a relatively-higher voltage portion and a relatively lower-voltage portion; and said engine cranking motor, said generator, said capacitor, said storage battery and said current-limiting means are located in said higher-voltage portion.

4. An electrical system as recited in claim 2, wherein:

said electrical system includes a relatively-higher voltage portion and a relatively lower-voltage portion; and said engine cranking motor, said generator, said capacitor, said storage battery, said blocking means and said current-limiting means are located in said higher-voltage portion.

5. An electrical system as recited in claim 1, further comprising:

blocking means coupled for allowing current flow through said blocking means from said capacitor to said engine cranking motor and for blocking current flow through said blocking means from said generator to said capacitor; and second current-limiting means coupled in parallel with said blocking means.

6. An electrical system as recited in claim 4, further comprising:

second blocking means coupled for allowing current flow from said capacitor to said engine cranking motor and for blocking current flow through said second blocking means from said generator to said capacitor; and second current-limiting means coupled in parallel with said second blocking means.

7. An electrical system as recited in claim 4, wherein:

said first and second current-limiting means are resistors; and said blocking means is a diode.

8. An electrical system as recited in claim 6, wherein;

said blocking means and said second blocking means are diodes; and said current-limiting means and said second current-limiting means are resistors.

9. An electrical system as recited in claim 7, wherein said engine cranking motor and said generator are integrated as a single component.

10. An electrical system as recited in claim 8, wherein said engine cranking motor and said generator are integrated as a single component.

11. An electrical system for a motor vehicle, said system comprising:

a capacitor;

an engine cranking motor coupled to receive motive power from said capacitor;

a storage battery;

an electrical generator having an electrical power output, said output coupled to provide electrical energy to said capacitor and to said storage battery;

blocking means for allowing current flow through said blocking means from said output of said electrical generator to said storage battery and for preventing current flow through said blocking means from said storage battery to said engine cranking motor.

12. An electrical system as recited in claim 11, further comprising current-limiting means coupled in parallel across said blocking means.

13. An electrical system as recited in claim 11, wherein:

said electrical system includes a relatively-higher voltage portion and a relatively lower-voltage portion; and said engine cranking motor, said generator, said capacitor, said storage battery and said blocking means are located in said higher-voltage portion.

14. An electrical system as recited in claim 12, wherein:

said electrical system includes a relatively-higher voltage portion and a relatively lower-voltage portion; and said engine cranking motor, said generator, said capacitor, said storage battery, said blocking means and said current-limiting means are located in said higher-voltage portion.

15. An electrical system as recited in claim 11, further comprising:

second blocking means coupled for allowing current flow from said capacitor to said engine cranking motor and for blocking current flow through said second blocking means from said generator to said capacitor; and current-limiting means coupled in parallel with said second blocking means.

16. An electrical system as recited in claim 14, further comprising:

second blocking means coupled for allowing current flow from said capacitor to said engine cranking motor and for blocking current flow through said second blocking means from said generator to said capacitor; and second current-limiting means coupled in parallel with said second blocking means.

17. An electrical system as recited in claim 14, wherein:

said first and second blocking means are diodes; and said current-limiting means is a resistor.

18. An electrical system as recited in claim 16, wherein:

said blocking means and said second blocking means are diodes; and said current-limiting means and said second current-limiting means are resistors.

19. An electrical system as recited in claim 17, wherein said engine cranking motor and said generator are integrated as a single component.

20. An electrical system as recited in claim 18, wherein said engine cranking motor and said generator are integrated as a single component.

* * * * *